US005152873A

United States Patent [19]

Juhas et al.

[11] Patent Number: 5,152,873

[45] Date of Patent: Oct. 6, 1992

[54] HEADBOX FOR A PAPERMAKING MACHINE

[75] Inventors: Simon Juhas, Nattheim; Gernot Kinzler, Heidenheim; Robert Wolf, Herbrechtingen, all of Fed. Rep. of Germany

[73] Assignee: J. M. Voith GmbH, Fed. Rep. of Germany

[21] Appl. No.: 839,474

[22] Filed: Feb. 19, 1992

[30] Foreign Application Priority Data

Feb. 20, 1991 [DE] Fed. Rep. of Germany ..... 4105237

[51] Int. Cl.[5] ..... D21F 1/02

[52] U.S. Cl. ..... 162/336; 162/347

[58] Field of Search ..... 162/336, 344, 347

[56] References Cited

U.S. PATENT DOCUMENTS 4,980,026 12/1990 Kade ..... 162/336

5,034,101 7/1991 Wolf et al. ..... 162/336

FOREIGN PATENT DOCUMENTS 3535849 4/1987 Fed. Rep. of Germany ..... 162/344

*Primary Examiner*—Karen M. Hastings

*Attorney, Agent, or Firm*—Ostrolenk, Faber, Gerb & Soffen

[57] ABSTRACT

A headbox for a papermaking machine has an outlet channel having the width of the machine which is limited by a rigid channel wall and by a movable channel wall. The movable channel wall is part of a channel-wall support. Between the latter and a supporting member, there is a pressure cushion which counteracts the pressure prevailing in the outlet channel. A lift device is swingably mounted, at one end, on the rigid headbox housing and, on the other end, on the channel-wall support. In each of the two end walls of the channel-wall support, there is provided a spherical joint, the center point of which lies in a plane extending through the end point of the channel width. The lift device is coupled to the spherical joint by means of a C-shaped spindle head.

23 Claims, 3 Drawing Sheets

HEADBOX FOR A PAPERMAKING MACHINE

BACKGROUND OF THE INVENTION

The present invention relates to a headbox for a machine for the manufacture of fiber webs from a pulp slurry, and in particular for the manufacture of paper webs. Such a headbox is described in U.S. Pat. No. 5,034,101 by the inventors herein, and the present invention is an improvement thereover.

One essential element of this headbox is the movable channel wall which defines one side of the pulp discharge channel. The movable wall is stiffened by a box-shaped channel-wall support. In order to counteract the pressure of the slurry prevailing in the outlet channel and the bending of the channel-wall support which results therefrom, a supporting member is provided. Between the channel-wall support and the supporting member, a pressure cushion is arranged to counteract the pressure of the slurry on the movable channel wall.

The above patent describes measures which are intended to avoid the introduction of a moment of flexure into the movable channel wall as a result of the supporting force of the lift device. For this purpose, it suggests the following. The lift device acts directly on the channel wall at each end of the movable channel wall. The line of action of the lift device is so arranged that it extends through the end point of the width of the channel. In other words, the distance between the lines of action of the two lift devices arranged on the operator and drive sides of the headbox is equal to the width of the channel.

However, reducing this proposal to practice is considerably difficult since the pressure cushion must extend substantially over the entire cross machine length of the channel-wall support and of the supporting member. In other words, the length of the pressure cushion must be at least approximately equal to the width of the channel. Furthermore, an easily flexible connection must be provided at each end of the channel-wall support between the channel-wall support and the supporting member. Also, as seen in front view, the central axis of the flexible connection must extend through the end point of the width of the channel. All of these are necessary in order for the channel-wall support to be kept free of flexure and for the inside width of the pulp outlet slot to be maintained constant in the transverse or cross machine direction. However, at each end of the channel-wall support, the lift device cannot extend directly along its line of action when that line extends through the end point of the channel width since, in that case, it would collide at least with the pressure cushion.

The aforementioned publication also describes a manner of construction in which the line of action of the lift device is arranged outside the channel width. In that case, however, the lift device is not coupled to the channel-wall support but instead to the supporting member. In this way, the supporting force of the lift device can be introduced free of bending moments into the movable channel wall. However, this requires a complicated and expensive development of the flexible connection which connects the channel-wall support to the supporting member, since the flexible connection must be adapted to transmit high pressure forces in the event of the failure of pressure in the pressure cushion.

SUMMARY OF THE INVENTION

It is an object of the present invention to improve the known headbox to make it possible to introduce the support forces of the lift device into the channel-wall support without bending moments being thereby produced in the channel-wall support.

The above and other objects are achieved by a headbox for a machine for the manufacture of fiber webs from a pulp slurry, in particular for the manufacture of paper webs, according to the invention. The headbox comprises an outlet channel having a cross machine channel width, the channel being defined by two channel walls which converge toward each other in the direction of pulp flow. In a downstream region, the two channel walls form an outlet slot having an inside width. One channel wall is disposed movably or pivotably at a point upstream of the outlet so as to be able to vary the inside width of the outlet slot. A lift device moves the channel wall and provides a supporting force to counteract pressure of the slurry in the outlet slot acting on the channel wall. The movable channel wall comprises part of a box-shaped channel-wall support. A pressure cushion extends over the width of the machine. It is arranged between the channel-wall support and a supporting member. The pressure cushion counteracts the pressure of the slurry acting on the movable channel wall. The movable channel wall support has two end walls. In each of the two end walls there is a joint having at least two degrees of freedom. The joint has a center point which lies approximately in a plane extending through an end point of the channel width. The lift device provides the supporting force through the joint to the channel-wall support.

According to the invention, the channel-wall support may receive, as the point of attack for the lift device, at each of its two ends, a spherical joint or a similar joint having two degrees of freedom. The center point of the joint lies approximately in a vertical plane which is determined by the end point of the channel width. In other words, the distance between the center points of the two joints which lie on the operator and drive sides of the headbox is at least approximately equal to the channel width.

The line of action of the supporting force of the lift device should, in its turn, preferably extend, at each end of the channel-wall support, through the end point of the channel width. For this purpose, in accordance with a first embodiment of the invention, the lift device has, as seen in a front view of the headbox, a C-shaped spindle head which is coupled to the end wall of the channel-wall support by means of the joint. The C-shaped spindle head can be considered a spatial detour around the end of the supporting member and around the end region of the pressure cushion.

It would, however, also be possible to use an L-shaped spindle head, in which case the line of action of the lift device would lie somewhat outside the channel width. In this case, however, the occurrence of a transverse force and a bending moment in the lift device would have to be tolerated.

In order that the C-shaped spindle head might be made as short as possible, each end of the supporting member is stepped down or bevelled from above, i.e. on its side facing away from the pressure cushion, in accordance with another aspect of the invention. Another possibility is to arrange the supporting member, as known per se, within the channel-wall support.

In accordance with another aspect of the invention, a bending shaft is provided which extends through the inside of the channel-wall support and is mounted in the two end walls of the latter in the joints. The lift device is coupled in this case to the ends of the bending shaft which are located outside the channel-wall support. In this case, therefore, the lift device is arranged somewhat outside the channel width at each end of the channel-wall support. The bending moment produced thereby is now taken up completely by the bending shaft. As in the inventive concept first described, one avoids the introduction of a bending moment into the movable channel wall by the lift device.

The flexible connection can be produced as a result of the invention solely by bolts or screws which are substantially only under tensile stress during operation. Upon failure of the pressure of the pressure cushion, the screws need only transmit the weight of the supporting member itself, for which they are only under slight compressive stress. This is true of all embodiments of the present invention. Two screws or bolts, and preferably necked-down bolts, are provided on each end of the channel-wall support, and they are arranged on both sides of the pressure cushion so that they do not collide with that cushion.

Other features and advantages of the present invention will become apparent from the following description of the invention which refers to the accompanying drawings.

DETAILED DESCRIPTION OF THE INVENTION

Figure 1:
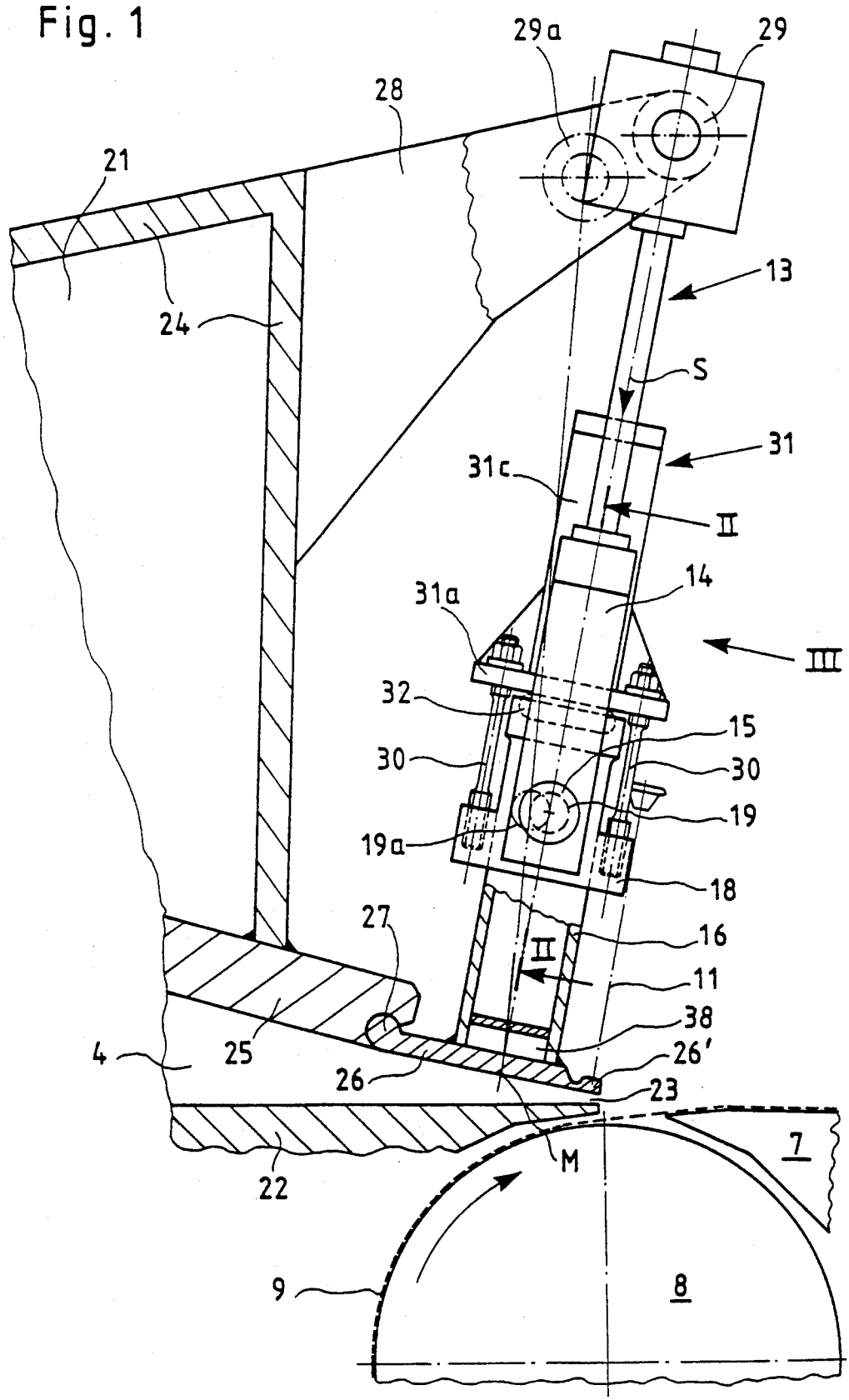
FIG. 1 shows the outlet end of a headbox, partially in longitudinal section and partially in side view.
Figure 2:
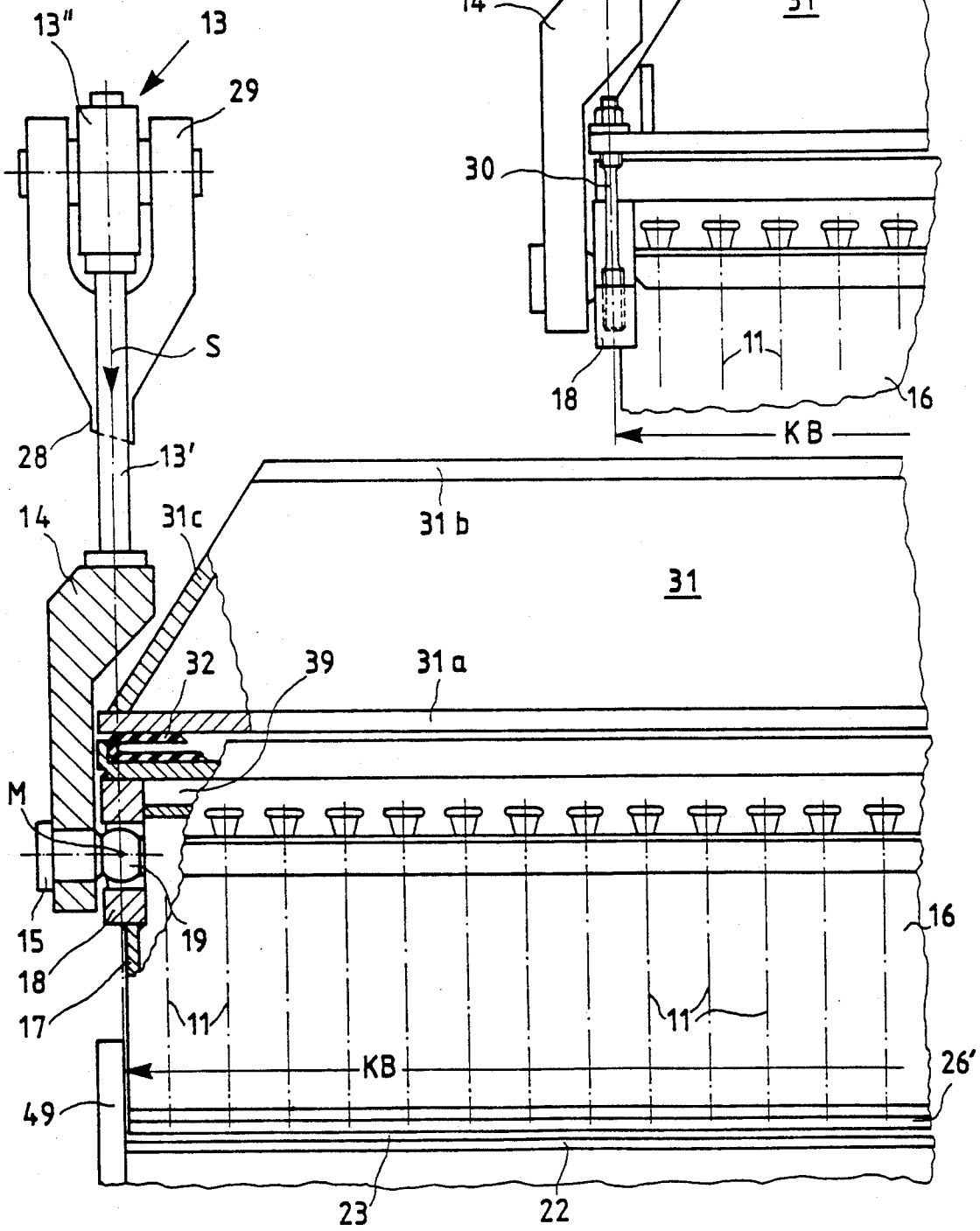
FIG. 2 is a front view, seen in the direction of the arrow III in FIG. 1, partially in section along the line II—II of FIG. 1.
Figure 3:
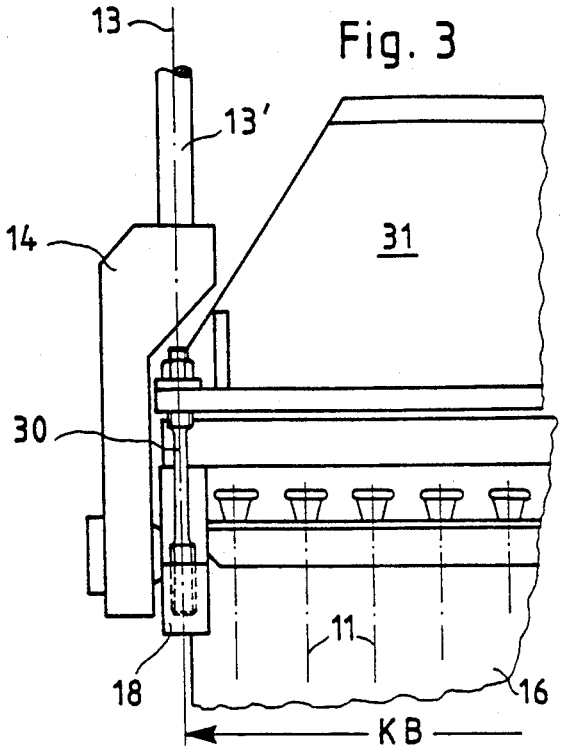
FIG. 3 shows a portion of FIG. 2 seen in the direction of the arrow III of FIG. 1.

Turning now to the drawings, the headbox shown in FIGS. 1 to 3 serves, in known manner, to feed a jet of pulp slurry having the width of the machine onto the endless wire screen or wire 9 of a paper manufacturing machine. The wire 9 travels, inter alia, over a breast roll 8 supported just beneath the outlet from the headbox and then over a stationary formation table 7 just after the roll 8 in the path of the wire.

For forming the jet of pulp slurry, the headbox has a nozzle-like outlet channel 4 which extends over the width of the machine. The channel 4 is defined by a lower stationary channel wall 22 and an upper channel wall 25, 26 spaced above the lower wall. The upstream part 25 of the upper channel wall is also stationary in the example shown, because it is a part of the stationary headbox housing 24. The downstream part 26 of the upper channel wall leading up to the outlet is movable, in order thereby to be able to vary the inside width, really the height, between the walls 22, 25 of the outlet slot 23. This mobility of the part 26 is preferably obtained by the downstream part 26 being fastened to the upstream part 25 at a pivot hinge 27. The cross machine "length" of the outlet slot 23, i.e. the so-called channel width between side walls 49, is designated KB in FIG. 2.

In order to stiffen the movable channel wall 26, a channel-wall support 16, which is, for instance, of box shape, is placed on the top of the channel wall and is rigidly attached to it, for instance, by welding. Above the channel-wall support 16, there is a supporting member 31, which is, for instance, also of box shape. Both of the supports 16 and 31 extend over the entire width of the machine. They are connected only at their two ends, i.e. on the operator side and on the drive side of the paper making machine by means of flexible connecting elements, for instance, necked down bolts 30 with a reduced shaft diameter. (See FIGS. 1 and 3). Swinging of the channel wall 26, with a channel-wall support 16 and supporting member 31 around the axis of the hinge 27 is effected by means of a lift device 13, described further below.

Between the channel-wall support 16 and the supporting member 31, there is a pressure cushion 32, which is, for instance, in the form of a hose. The hose can be acted on by a pressurized fluid. It extends over the entire channel width KB, as shown in FIG. 2. The pressure prevailing in the pressure cushion 32 can be varied by control elements, not shown. With due consideration of the fluid pressure prevailing in the outlet channel 4 and of the dead weight of the movable channel wall 26 and of the channel-wall support 16, the pressure in the cushion 32 can, for instance, be selected so that the movable channel wall 26 is completely free of flexure. As a result, the supporting member 31 is bent slightly upward. Control of the fluid pressure based on continuous measurement of the flexure of the channel-wall support 16, as is known per se, is advisable in this connection.

In order that thermal deformations of the movable channel wall 26 can also be excluded, temperature-control channels 38 and 39 are provided within the channel-wall support 16. The lower temperature-control channel 38 is provided directly on the top of the movable channel wall 26. The upper temperature-control channel 39 (FIG. 2) extends along the bottom of the upper longitudinal wall. Conduits and temperature-control devices (not shown) insure that liquid of substantially the same temperature flows through both channels 38 and 39. That temperature is preferably equal to the temperature of the pulp slurry. In this way, the channel-wall support 16, including the movable channel wall 16, can be held at the same temperature.

The lift device 13, which has already been mentioned, comprises a spindle 13' and gearing 13'' which can displace the spindle 13' in a longitudinal direction by means of a motor, for example, not shown. The gearing 13'' is swingably mounted in a fork head 29 which is part of a bracket 28. The bracket 28 lies in the plane of and is attached to the side wall 21 of the stationary headbox housing 24. Thus, the force of reaction resulting from the supporting force S of the spindle 13' is introduced into the side wall 21 directly, i.e. without a bending moment being produced.

The end wall 17 of the channel-wall support 16 includes within it a reinforcement piece 18, in which a spherical joint 19 is arranged. A C-shaped spindle head 14, which is rigidly connected to the spindle 13' is swingably mounted to the joint 19. Note that the axis of the spindle 13' and of the center point (M) of the spherical joint 19 lie in a vertical plane which is determined by the end point of the channel width KB. Thus, the supporting force S is transmitted to the channel-wall support 16 without a bending moment being thereby introduced into the channel-wall support 16. In the example shown, the lower leg of the C-shaped spindle head 14 is defined by a rigidly inserted support pin 15. The pin is provided on its outer end with a spherical head which is part of the spherical joint 19. However, constructions which differ from this are also conceivable. It is only important that the joint 19 be a spherical joint, or a similar joint which has two degrees of freedom like a spherical joint does, so that deformation of the C-shaped spindle head 14 (under the supporting force S) cannot lead to a jamming of the joint 19 or cannot produce a bending moment in the channel-wall support.

Figure 4:
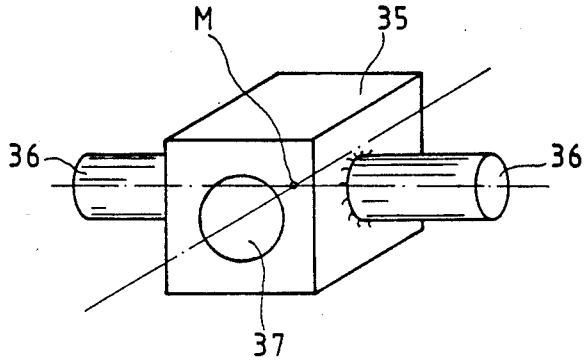
FIG. 4 shows the cross head of a universal joint.

It is possible, for instance, to use a universal joint with the crosshead 35 shown in FIG. 4 rather than the spherical joint 19. This crosshead has two pins 36 which are coaxial to each other and a hole 37 at right angles thereto. The pin axis and hole axis both extend preferably horizontally and intersect at the center point M of the joint. That center point M must again lie in the vertical plane extending through the end point of the channel width KB. The pins 36 rest in bearings (not shown) which are fastened on the outside of the end wall 17 of the channel-wall support 16. The hole 37 receives the support pin of the spindle head 14. The support pin, however, is now cylindrical rather than spherical.

In order that the C-shaped spindle head 14 might be kept as short as possible, the supporting member 31 is developed as follows. It has a lower longitudinal wall 31*a* against the bottom of which the pressure cushion 32 rests and which therefore extends over the entire width of the machine. It further has an upper longitudinal wall 31*b* which is shorter in the cross-machine direction than the lower longitudinal wall 31*a*. Accordingly, one end wall 31*c* is, for instance, arranged obliquely so that the spindle head 14 and the supporting member 31 do not interfere with each other.

The flexible connecting elements 30 for connecting the supporting member 31 with the channel-wall support 16 are developed as follows. On each end of the channel-wall support, there are provided two necked-down or narrowed shaft bolts 30. Their lower ends are screwed into the reinforcement piece 18. The two necked-down bolts 30 are arranged, as shown in FIG. 1, on both sides of the channel-wall support 16 and therefore also on both sides of the spindle head 14. As shown in FIG. 3, the axes of the necked-down bolts 30 lie in the plane determined by the end point of the channel width KB.

FIGS. 2 and 3 show only the one end of the channel-wall support 16 and of the supporting member 31 with a lift device 13. The other end, not shown, is developed as a mirror image.

In principle, it would be possible to practice the invention even if the supporting member 31 were not arranged (as shown) on the upper longitudinal wall of the channel-wall support but, as known per se, within the channel-wall support. However, the development shown is preferred, despite the fact that it takes up more space, among other reasons because any necessary maintenance work can be carried out more easily.

It is diagrammatically shown that the outermost or outlet end 26' of the movable channel wall 26 is locally deformable, as is known per se, by means of a plurality of individually actuatable spindles 11 arrayed at intervals along length KB. In this way, or else by means of a ledge-shaped and also deformable profile bar, the operator can effect small local corrections of the inside dimension of the outlet slot 23.

In FIG. 1, the axes of the fork head 29 and of the joint 19 are arranged in the central plane of the supports 16 and 31. Thus, the line of action of the support force S in the normal operating position of the channel wall 26 extends through the middle M' thereof, where the resultant from the pressure of the slurry acts on the channel wall 26. In this way, the resultant and the supporting force S completely cancel each other out. As an alternative to this, the axes of the fork head and of the joint can also be arranged in the position designated 29*a* and 19*a*. In this case, the supporting force S extends at a smaller distance from the headbox housing 24 and the bearing brackets 28 are shorter, but still extends through the center M' of the channel wall 26 so that no moment of torsion acts on the channel-wall support 16.

Figure 5:
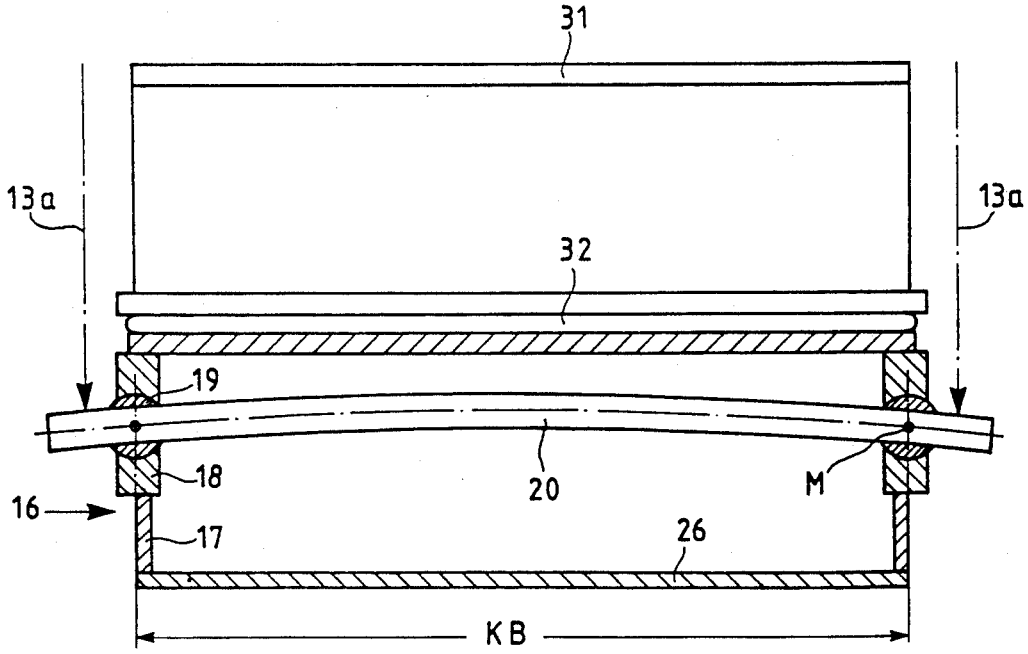
FIG. 5 is a diagrammatic section through another embodiment of the headbox.

In FIG. 5, those parts that are the same as in FIG. 2 have been provided with the same reference numbers. Present there are the movable channel wall 26, the channel-wall support 16, the pressure cushion 32, and the supporting member 31 and one spherical joint 19 in each end wall 17 with its reinforcement pieces 18. Differing from FIGS. 1 to 3, a bending shaft 20 is provided in FIG. 5 which rests in the spherical joints 19 and extends through the channel-wall support 16 and extends somewhat beyond the end walls 17 where the lift devices 13*a* act on the bending shaft 20 by means of spherical joints, not shown.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A headbox for a machine for the manufacture of fiber webs from a pulp slurry, the headbox comprising:

an outlet channel having a cross machine channel width, the channel being defined by two channel walls which converge toward each other in a direction of pulp flow, the channel walls having a downstream region in the direction of flow at which the channel walls form an outlet slot having a channel inside width;

one of said channel walls being disposed movably for varying the inside width of the outlet slot, a lift device connected with and for moving the one channel wall and for providing a supporting force to counteract pressure of the slurry acting on the one channel wall;

the one movable channel wall comprising part of a box-shaped channel-wall support; a supporting member above the one channel wall; a pressure cushion extending over the width of the machine and being arranged between the channel-wall support and the supporting member, the pressure cushion counter-acting the pressure of the slurry acting on the one channel wall;

the channel wall support having two end walls; a joint in each of the two end walls, the joint having at least two degrees of freedom, the joint having a center point lying approximately in a plane extending through an end point of the cross machine channel width, the lift device providing the supporting force through the joint to the channel-wall support.

2. A headbox according to claim 1, wherein the one channel wall comprises a fixed part and also comprises a movable part toward the outlet slot from the channel, the movable part having at an upstream end at which it is pivotally mounted to the fixed part.

3. A headbox according to claim 1, comprising a respective spindle head by which the lift device is coupled at each end of the channel-wall support to the joint, a line of action of the supporting force of the lift device extending approximately through the end point of the channel width.

4. A headbox according to claim 3, wherein the spindle head is C-shaped.

5. A headbox according to claim 4, wherein the ends of the supporting member are stepped down or bevelled from above.

6. A headbox according to claim 3, wherein the supporting member is disposed within the channel-wall support.

7. A headbox according to claim 1, further comprising:

a bending shaft extending through the inside of the channel-wall support, along the length of the channel wall support and through the two end walls of the channel wall support;

the bending shaft being mounted at each end by the joint in the end wall and being connected, outside the channel-wall support, to the lift device at a small distance from the joint.

8. A headbox according to claim 1, wherein a flexible connection between the channel-wall support and supporting member is provided on each end of the channel-wall support, the flexible connection having a center axis extending approximately through the end point of the channel width.

9. A headbox according to claim 8, further having two bolts arranged on both sides of the pressure cushion.

10. A headbox according to claim 9, wherein the two bolts extend approximately through the end point of the channel width.

11. A headbox according to claim 10, wherein the two bolts comprise necked-down bolts.

12. A headbox according to claim 1, wherein the joint comprises a spherical joint.

13. A headbox as recited in claim 1, wherein the joint comprises a universal joint.

14. A headbox for a machine for the manufacture of fiber webs from a pulp slurry, the headbox comprising:

an outlet channel having a cross machine channel width, the channel being defined by two channel walls which converge toward each other in a direction of pulp flow, the channel walls having a downstream region in the direction of flow at which the channel walls form an outlet slot having a channel inside width;

one of said channel walls being pivotally disposed at an upstream end thereof so as to be able to vary the inside width of the outlet slot, a lift device being provided for moving the one channel wall and for providing a supporting force for counteracting pressure of the slurry acting on the one channel wall;

the one pivotable channel wall comprising part of a box-shaped channel-wall support; a supporting member; a pressure cushion extending over the width of the machine and being arranged between the channel-wall support and the supporting member, the pressure cushion counter-acting the pressure of the slurry acting on the one channel wall;

the channel wall support having two end walls, a spherical joint having at least two degrees of freedom in each of the two end walls, the joint in each of the two end walls having a center point lying approximately in a plane extending through an end point of the cross-machine channel width, the lift device providing the supporting force through the joint to the channel-wall support.

15. A headbox according to claim 14, further comprising a spindle head coupling the lift device at each end of the channel-wall support to the joint, the line of action of the supporting force of the lift device extending essentially through the end point of the channel width.

16. A headbox according to claim 15, wherein the spindle head is C-shaped.

17. A headbox according to claim 16, wherein the ends of the supporting member are stepped down or bevelled from above.

18. A headbox according to claim 15, wherein the supporting member is arranged within the channel-wall support.

19. A headbox according to claim 13, further comprising:

a bending shaft extending through the inside of the channel-wall support along the length of the channel wall support and through the two end walls of the channel wall support;

the bending shaft being mounted at each end by the joint in the end wall and being connected, outside the channel-wall support, to the lift device at a small distance from the joint.

20. A headbox according to claim 14, wherein a flexible connection between the channel-wall support and supporting member is provided on each end of the channel-wall support, the flexible connection having a center axis extending approximately through the end point of the channel width.

21. A headbox according to claim 20, further comprising two bolts arranged on both sides of the pressure cushion.

22. A headbox according to claim 21, wherein the two bolts extend through the end point of the channel width.

23. A headbox according to claim 22, wherein the two bolts comprise necked-down bolts.

* * * * *